US011389813B2

(12) United States Patent
Nakamura

(10) Patent No.: US 11,389,813 B2
(45) Date of Patent: Jul. 19, 2022

(54) TRIGGER TYPE LIQUID EJECTOR

(71) Applicant: YOSHINO KOGYOSHO CO., LTD., Tokyo (JP)

(72) Inventor: Hiroyuki Nakamura, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 177 days.

(21) Appl. No.: 16/976,284

(22) PCT Filed: May 24, 2019

(86) PCT No.: PCT/JP2019/020730
§ 371 (c)(1),
(2) Date: Aug. 27, 2020

(87) PCT Pub. No.: WO2019/230602
PCT Pub. Date: Dec. 5, 2019

(65) Prior Publication Data

US 2021/0362175 A1 Nov. 25, 2021

(30) Foreign Application Priority Data

May 31, 2018 (JP) ..... JP2018-105653
May 31, 2018 (JP) ..... JP2018-105654

(51) Int. Cl.
*B05B 11/00* (2006.01)

(52) U.S. Cl.
CPC ..... *B05B 11/3011* (2013.01); *B05B 11/0044* (2018.08); *B05B 11/3045* (2013.01);
(Continued)

(58) Field of Classification Search
CPC ..... B05B 11/3011; B05B 11/0044; B05B 11/3045; B05B 11/3063; B05B 11/3097; B05B 11/0032; B05B 11/0067
See application file for complete search history.

(56) References Cited

U.S. PATENT DOCUMENTS 5,462,209 A * 10/1995 Foster ..... B05B 11/3011 222/376
5,467,901 A * 11/1995 Foster ..... B05B 11/3011 222/376

(Continued)

FOREIGN PATENT DOCUMENTS

CN 1171301 A 1/1998
CN 1442236 A 9/2003

(Continued)

OTHER PUBLICATIONS

Aug. 13, 2019 Search Report issued in International Patent Application No. PCT/JP2019/020730.

(Continued)

*Primary Examiner* — Vishal Pancholi
*Assistant Examiner* — Bob Zadeh
(74) *Attorney, Agent, or Firm* — Oliff PLC

(57) ABSTRACT

A trigger type liquid ejector includes an ejector body and nozzle, the ejector body includes a vertical supply pipe, ejection barrel, trigger, piston, and cylinder, a recovery passage brings the cylinder in communication with the vertical supply pipe via a space between a piston body and a piston guide of the cylinder formed in the ejector body, the vertical supply pipe has a lower inner tube part where the recovery passage opens, the trigger type liquid ejector further includes an upright and inverted posture adaptor attached into the lower inner tube part where communication between the recovery passage and an inside of a container body is blocked, and a communication passage brings the recovery passage in communication with the inside of the container body forms between an outer circumferential surface of the upright and inverted posture adaptor and an inner circumferential surface of the lower inner tube part.

8 Claims, 10 Drawing Sheets

(52) U.S. Cl.
CPC ..... *B05B 11/3063* (2013.01); *B05B 11/3097* (2013.01); *B05B 11/0032* (2013.01)

(56) References Cited

U.S. PATENT DOCUMENTS

| | | | | |
|---|---|---|---|---|
| 5,540,360 | A * | 7/1996 | Foster | B05B 11/0075 222/376 |
| 10,406,548 | B2 * | 9/2019 | Fujiwara | B05B 11/00 |
| 2001/0030246 | A1 | 10/2001 | Schuckmann | |
| 2008/0191061 | A1 * | 8/2008 | Inaba | B05B 11/0029 239/533.1 |
| 2008/0277430 | A1 | 11/2008 | Maas et al. | |
| 2011/0147419 | A1 | 6/2011 | Tada et al. | |
| 2017/0014844 | A1 | 1/2017 | Fujiwara et al. | |
| 2017/0065994 | A1 * | 3/2017 | Fujiwara | B05B 11/0044 |
| 2021/0362175 | A1 * | 11/2021 | Nakamura | B05B 11/3011 |

FOREIGN PATENT DOCUMENTS

| | | | |
|---|---|---|---|
| CN | 201033314 | Y | 3/2008 |
| CN | 104411412 | A | 3/2015 |
| CN | 105358258 | A | 2/2016 |
| CN | 106061623 | A | 10/2016 |
| CN | 106414267 | A | 2/2017 |
| CN | 106457286 | A | 2/2017 |
| EP | 0 867 229 | A1 | 9/1998 |
| JP | H10-272391 | A | 10/1998 |
| JP | 2001-286797 | A | 10/2001 |
| JP | 2007-175609 | A | 7/2007 |
| JP | 2016-159929 | A | 9/2016 |
| JP | 2017-047350 | A | 3/2017 |
| JP | 2017-213496 | A | 12/2017 |
| JP | 2017-214076 | A | 12/2017 |
| JP | 2017214076 | A * | 12/2017 |
| WO | 2015/129268 | A1 | 9/2015 |
| WO | 2016/068191 | A1 | 5/2016 |

OTHER PUBLICATIONS

Tan et al.; Analysis of Cause of Unfinished Spray in the Use of Aerosol Paint; GuangZhou Chemical Industry; 2018; vol. 46, No. 4.
Sep. 1, 2021 Office Action issued in Chinese Patent Application No. 201980024095.1.
Jan. 26, 2022 Notice of Allowance issued in Chinese Patent Application No. 201980024095.1.
Feb. 18, 2022 Extended European Search Report issued in Patent Application No. 19811413.4.

* cited by examiner

TRIGGER TYPE LIQUID EJECTOR

TECHNICAL FIELD

The present invention relates to a trigger type liquid ejector.

Priority is claimed on Japanese Patent Application No. 2018-105653, filed May 31, 2018, and Japanese Patent Application No. 2018-105654, filed May 31, 2018, the contents of which are incorporated herein by reference.

BACKGROUND ART

A trigger type liquid ejector having configurations disclosed in the following Patent Document 1 is known. The trigger type liquid ejector includes an ejector body mounted on a container body in which liquid is accommodated, and a nozzle disposed in front of the ejector body and in which an ejection hole configured to eject the liquid is formed.

The ejector body includes a vertical supply pipe, an ejection barrel, and a trigger mechanism, the vertical supply pipe extends in an upward/downward direction and is configured to suction the liquid in the container body, the ejection barrel is disposed in front of the vertical supply pipe and is configured to guide the liquid in the vertical supply pipe to the ejection hole, and the trigger mechanism has a trigger disposed in front of the vertical supply pipe to be movable rearward in a state where the trigger is biased forward.

The above-described trigger mechanism includes a cylinder and a piston, the cylinder communicates with the inside of the ejection barrel through the vertical supply pipe, and the piston is linked to the trigger and is configured to slide inside the cylinder in a forward/rearward direction according to forward and rearward movement of the trigger. The inside of the cylinder inside is pressurized and depressurized according to forward and rearward movement of the piston.

In the above-described trigger type liquid ejector, as the trigger is pulled rearward, the piston is moved rearward while being guided by a piston guide formed in the cylinder. Thereby, the inside of the cylinder is pressurized, and liquid in the cylinder passes through the vertical supply pipe and the ejection barrel and is ejected from the ejection hole.

In the above-described trigger type liquid ejector, for example when the amount of the liquid remained in the container body gets fewer, air may enter the cylinder together with the liquid. The air entering the cylinder is tends to remain in the cylinder as air bubbles by the air being mixed with the liquid in the cylinder. The air bubbles in the cylinder may cause ejection failure.

Therefore, in the trigger type liquid ejector, a configuration is considered in which a recovery passage is provided to bring the inside of the cylinder in communication with the inside of the container body via the inside of the piston guide, the inside of the vertical supply pipe, and the like, for example when the piston is moved to the most retracted position.

The above-described vertical supply pipe is formed in a double tubular shape having an inner tube and an outer tube. A valve seat that protrudes from an inner circumferential surface of the inner tube is formed on the inner tube. A ball valve is accommodated in an accommodation space inside the inner tube, which is defined by the valve seat and a ceiling wall of the outer tube, in a state where the ball valve is configured to come in contact with and separate from the valve seat. The accommodation space communicates with the inside of the cylinder and the inside of the ejection barrel via a connection passage formed between an outer circumferential surface of the inner tube and an inner circumferential surface of the outer tube.

The operation when the trigger is moved is described in detail. As the trigger is pulled rearward, the piston is moved rearward while being guided by the piston guide formed in the cylinder. Thereby, the inside of the cylinder is pressurized. When the inside of the cylinder is pressurized, as the liquid in the cylinder flows into the accommodation space via the connection passage, the ball valve is pressed against the valve seat. Thereby, communication between the inside of the container body and the connection passage is blocked, and accordingly the liquid in the cylinder passes through the vertical supply pipe and the ejection barrel and is ejected from the ejection hole.

Further, as the piston is moved forward according to forward movement (return) of the trigger, the inside of the cylinder is depressurized. When the inside of the cylinder is depressurized, as the liquid in the container body is suctioned into the inner tube, the ball valve is pushed up. Accordingly, the ball valve is separated from the valve seat, and the liquid flows into the cylinder via a gap between the ball valve and the valve seat.

DOCUMENT OF RELATED ART

Patent Document

Patent Document 1: Japanese Unexamined Patent Application, First Publication No. 2017-47350

Patent Document 2: Japanese Unexamined Patent Application, First Publication No. 2007-175609

SUMMARY OF INVENTION

Technical Problem

In the above-described trigger type liquid ejector, an upright and inverted posture adaptor may be provided in a lower end portion of the vertical supply pipe in order to enable to eject the liquid in both of the upright and inverted postures (for example refer to Patent Document 2).

When the upright and inverted posture adaptor is provided in the trigger type liquid ejector having the recovery passage, communication between the recovery passage and the container body is blocked by the upright and inverted posture adaptor. In this case, the recovery passage may be filled with air bubbles which has been discharged to the recovery passage from the cylinder. Due to air bubbles which cannot pass through a space between the vertical supply pipe and the upright and inverted posture adaptor, the overflow (so-called dripping) of the liquid in the cylinder to the outside, for example via an external air introduction hole of the cylinder may occur.

Further, when the trigger type liquid ejector having the upright and inverted posture adaptor is used in the inverted posture, the ball valve separates from the valve seat due to its own weight. In this state, when the piston is moved rearward for ejection, the liquid in the cylinder or the connection passage may flow toward the container body via a gap between the ball valve and the valve seat. That is, in the inverted posture, since it is difficult to efficiently supply the liquid in the cylinder or the connection passage to the ejection barrel, it may be difficult to eject a desired amount of the liquid according to the movement amount of the piston. As a result, variation in the ejection amount of the trigger type liquid ejector may occur between the upright posture and the inverted posture.

An object of the present invention is to provide a trigger type liquid ejector capable of suppressing dripping of liquid.

An object of the present invention is to provide a trigger type liquid ejector capable of suppressing variation in ejection amount between an upright posture and an inverted posture.

Solution to Problem

A trigger type liquid ejector according to an aspect of the present invention includes: an ejector body which is mounted on a container body in which a liquid is accommodated; and a nozzle which is disposed in front of the ejector body, and in which an ejection hole configured to eject the liquid is formed, in which the ejector body includes: a vertical supply pipe which extends in an upward/downward direction, and is configured to suction the liquid in the container body; an ejection barrel which is disposed in front of the vertical supply pipe, and is configured to guide the liquid in the vertical supply pipe to the ejection hole; a trigger which is disposed in front of the vertical supply pipe to be movable rearward in a state where the trigger is biased forward; a piston which has a tubular piston body to which the trigger is linked and a sliding portion connected to the piston body, and is configured to move forward and rearward according to forward and rearward movement of the trigger; and a cylinder which has a piston guide inserted into the piston body, and inside of which is pressurized and depressurized by the sliding portion sliding on the cylinder according to forward and rearward movement of the piston, in which a recovery passage is formed in the ejector body, the recovery passage being configured to bring an inside of the cylinder in communication with an inside of the vertical supply pipe via a space between the piston body and the piston guide, in which the vertical supply pipe has a mounting tube into which the recovery passage opens, in which the trigger type liquid ejector further comprises an upright and inverted posture adaptor which is attached into the mounting tube in a state where communication between the recovery passage and an inside of the container body is blocked, in which the upright and inverted posture adaptor includes: an adaptor body which defines a first space and a second space, the first space being configured to bring the inside of the container body in communication with the inside of the vertical supply pipe via an upright posture introduction port, the second space being configured to bring the inside of the container body in communication with the first space via an inverted posture introduction port; and a first switching valve which is configured to block communication between the first space and the second space when the container body, on which the ejector body is mounted, is upright, and is configured to allow communication between the first space and the second space when the container body, on which the ejector body is mounted, is inverted, in which a communication passage is formed between an outer circumferential surface of the upright and inverted posture adaptor and an inner circumferential surface of the mounting tube, the communication passage being configured to bring the recovery passage in communication with the inside of the container body, and in which a minimum value of a flow passage cross-sectional area of the communication passage is larger than a minimum value of a flow passage cross-sectional area of the recovery passage.

With this configuration, air bubbles discharged from the cylinder into the recovery passage pass through the communication passage and are discharged into the container body. As a result, it is possible to eject the liquid in both of the upright and inverted postures of the trigger type liquid ejector, and it is possible to suppress dripping of liquid via an external air introduction hole or the like due to air bubbles remaining in the recovery passage or an intermediate space.

Particularly, in the aspect, as the minimum value of the flow passage cross-sectional area of the communication passage is larger than the minimum value of the flow passage cross-sectional area of the recovery passage, air bubbles can be efficiently discharged into the container body.

In the trigger type liquid ejector according to the aspect, the nozzle may include an accumulator valve which is disposed to be movable rearward in a state where the accumulator valve is biased forward, and is configured to openably close a front end opening portion of the ejection barrel.

With this configuration, when the pressure acting on the accumulator valve is equal to or more than a predetermined value, the accumulator valve is moved rearward to allow communication between the ejection hole and the inside of the ejection barrel. Accordingly, it is possible to secure the ejection pressure of the liquid ejected from the ejection hole.

Further, even if air bubbles or liquid that cannot be ejected from the ejection hole remains in the cylinder when the pressure acting on the accumulator valve is less than the predetermined value, the air bubbles or liquid remaining in the cylinder can be returned into the container body via the recovery passage and the communication passage. Accordingly, it is possible to suppress dripping of liquid while stabilizing the ejection operation.

In the trigger type liquid ejector according to the aspect, the inverted posture introduction port may be disposed on a first side with respect to a center of the upright and inverted posture adaptor in the forward/rearward direction, and the communication passage may be disposed on a second side with respect to the center of the upright and inverted posture adaptor in the forward/rearward direction.

With this configuration, the inverted posture introduction port and the communication passage are separated from each other in the forward/rearward direction. Accordingly, for example at the time of the ejection operation in the inverted posture, it is possible to easily suppress air bubbles discharged from the communication passage from flowing again into the cylinder via the inverted posture introduction port.

In the trigger type liquid ejector according to the aspect, the upright and inverted posture adaptor may be attached to a lower end portion of the ejector body, the vertical supply pipe may be formed in a topped tubular shape, the vertical supply pipe may include: an inner tube which communicates with the container body, and has the mounting tube and a valve seat protruding from an inner circumferential surface of the inner tube; and an outer tube which surrounds the inner tube, wherein a connection passage is formed between the outer tube and an outer circumferential surface of the inner tube, the connection passage being configured to communicate with the inside of the ejection barrel and the inside of the cylinder, a second switching valve may be accommodated in an accommodation space inside the inner tube, the accommodation space being defined by the valve seat and a ceiling wall of the vertical supply pipe and being configured to communicate with the connection passage, the second switching valve being configured to come in contact with and separate from the valve seat, and where D1 is a minimum valve of a cross-sectional area of a gap between the second switching valve and the valve seat in a state where the second switching valve separates from the valve seat and comes in contact with the ceiling wall due to its own weight when the container body is inverted, in a direction perpendicular to the valve seat when seen from a vertical cross-sectional view along the upward/downward direction, and D2 is a minimum valve of an opening area of the valve seat, D1 and D2 may be set that $0.62 \leq D2/D1 \leq 3.62$.

With this configuration, by setting D2/D1 to equal to or more than 0.62, the cross-sectional area D1 can be made relatively small. This makes it difficult for the liquid flowing in the connection passage to pass through the gap between the second switching valve and the valve seat at the time of the ejection operation in the inverted posture. That is, by making the flow of the liquid into the ejection barrel dominant, among the liquid flowing in the connection passage, as compared with the flow of the liquid through the gap, the liquid can be efficiently introduced into the ejection barrel. As a result, it is possible to suppress the variation in the ejection amount of the trigger type liquid ejector between the upright posture and the inverted posture.

By setting D2/D1 to equal to or less than 3.62, it is possible to set the size of the gap such that the liquid suctioned from the container body when the pressure in the cylinder becomes a negative pressure can pass through the gap. Thereby, the piston can be smoothly moved, and therefore the liquid can be efficiently introduced into the cylinder and the operability of the trigger can be improved.

In the trigger type liquid ejector according to the aspect, the cross-sectional area D1 may be set that $1.7\ mm^2 \leq D1 \leq 10.0\ mm^2$.

With this configuration, by setting D1 to equal to or less than $10.0\ mm^2$, the cross-sectional area D1 can be made relatively small. Accordingly, it is possible to secure the ejection amount in the inverted posture as is described above, and it is possible to suppress the variation in the ejection amount of the trigger type liquid ejector between the upright posture and the inverted posture.

By setting D1 to equal to or more than $17\ mm^2$, the liquid can be efficiently introduced into the cylinder when the pressure in the cylinder becomes a negative pressure, and the operability of the trigger can be improved.

In the trigger type liquid ejector according to the aspect, the specific gravity of the second switching valve may be larger than that of water.

With this configuration, the second switching valve can reliably seat on the valve seat at the time of the upright posture. Thereby, the ejection amount in the upright posture can be stabilized.

Advantageous Effects of Invention

According to each aspect of the present invention, it is possible to suppress dripping of liquid in the trigger type liquid ejector.

According to each aspect of the present invention, it is possible to suppress variation in the ejection amount of the trigger type liquid ejector between the upright posture and the inverted posture.

DESCRIPTION OF EMBODIMENTS

Figure 1:
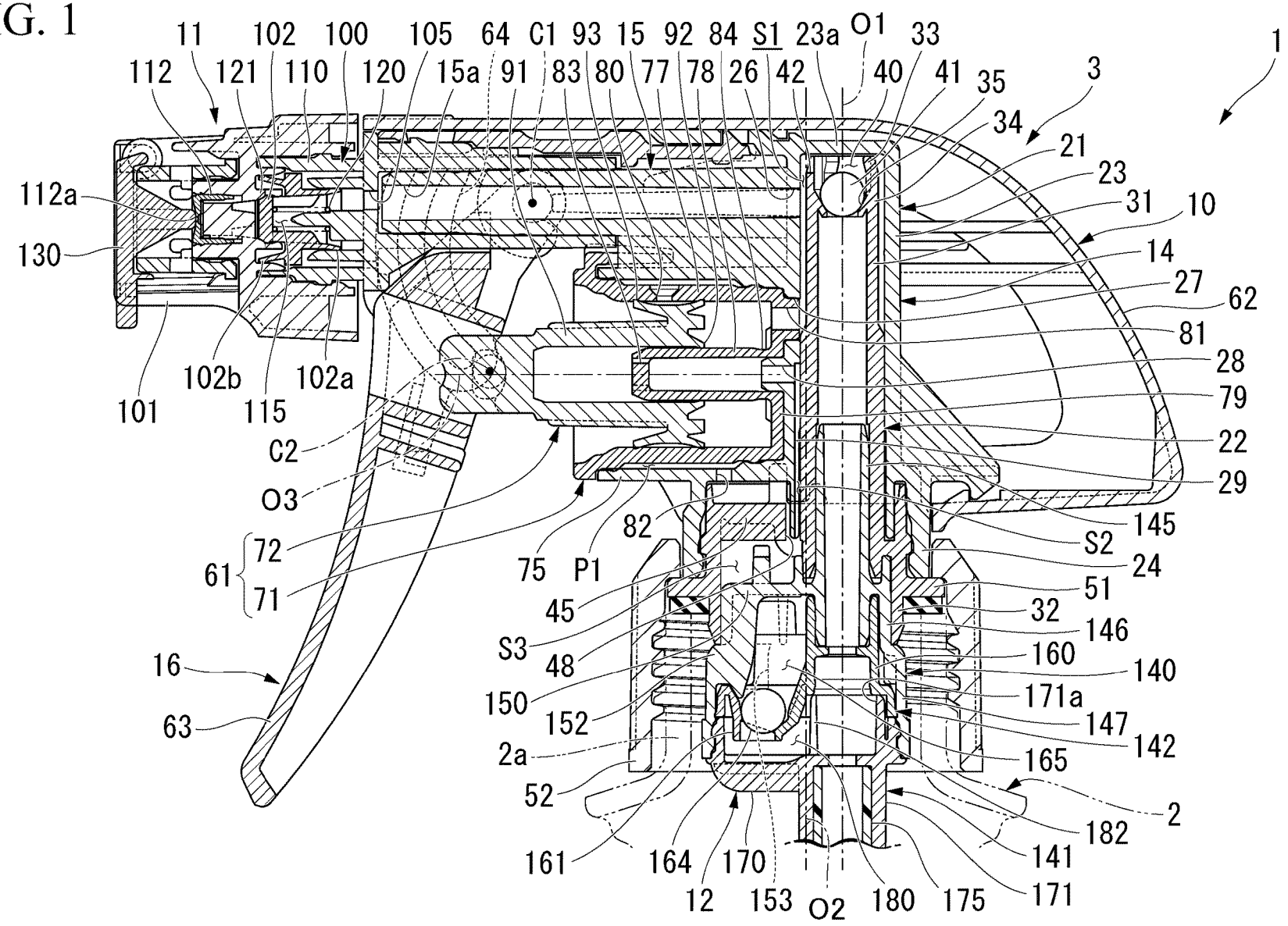
FIG. 1 is a partially cross-sectional view of an ejection container according to a first embodiment.

Hereinafter, embodiments according to the present invention will be described with reference to the accompanying drawings. In the following description, an ejection container formed by attaching a trigger type liquid ejector according to the present invention to a container body will be described. Further, in each of the following embodiments, the same reference numerals may be given to corresponding components, and a description thereof may be omitted.

First Embodiment

An ejection container 1 shown in FIG. 1 includes a container body 2 in which a liquid is accommodated, and a trigger type liquid ejector (which will hereinafter be simply referred to as "ejector 3") which is detachably attached to a mouth portion 2*a* of the container body 2.

The ejector 3 includes an ejector body 10, a nozzle 11 and an upright and inverted posture adaptor 12. As the liquid accommodated in the container body 2 of the present embodiment, a detergent (which contains a surfactant and becomes in a foamy state) used in a bathroom, a toilet or the like, and having a viscosity equivalent to that of water is preferably used. However, the liquid accommodated in the container body 2 can be appropriately changed.

The ejector body 10 includes a vertical supply pipe 14, an ejection barrel 15, and a trigger mechanism 16, and the vertical supply pipe 14 is configured to suction the liquid in the container body 2, the ejection barrel 15 is configured to guide the liquid suctioned by the vertical supply pipe 14 to the nozzle 11, and the trigger mechanism 16 is configured to cause the liquid to flow inside the vertical supply pipe 14 and the ejection barrel 15.

In the following description, a direction along a first axis O1 of the vertical supply pipe 14 (an upper outer tube part 23 to be described later) is referred to as an upward/downward direction. In the upright posture of the ejection container 1, a side of the container body 2 in the upward/downward direction is referred to as a lower side, and a side of the ejector 3 in the upward/downward direction is referred to as an upper side. In a plan view seen in the upward/downward direction, a direction intersecting the first axis O1 is referred to as a radial direction. One direction in the radial direction is referred to as a forward/rearward direction, a direction toward which the ejection barrel 15 extends from the vertical supply pipe 14 is referred to as a front side, and an opposite direction thereof is referred to as a rear side. A direction in the radial direction perpendicular to the forward/rearward direction is referred to as a leftward/rightward direction. In the drawings, the first axis O1 is eccentric rearward with respect to a container axis of the container body 2. The first axis O1 may be coaxial with the container axis.

The vertical supply pipe 14 includes an outer tube 21 and an inner tube 22.

The outer tube 21 is formed in a multi-stage tubular shape having parts whose diameter increases toward a lower side. Specifically, the outer tube 21 includes an upper outer tube part 23, and a lower outer tube part 24 extending downward from the upper outer tube part 23. In the present embodiment, the upper outer tube part 23 and the lower outer tube part 24 are formed in a topped tubular shape.

A discharge port 26 which opens forward is formed in an upper portion of a circumferential wall of the upper outer tube part 23.

A supply port 27 and an exhaust port 28 are formed in a middle portion in the upward/downward direction of the circumferential wall of the upper outer tube part 23, and the supply port 27 and the exhaust port 28 open forward. The supply port 27 is positioned above the exhaust port 28. The supply port 27 may be positioned below the exhaust port 28.

A communication groove 29 which extends in the upward/downward direction is formed on an inner circumferential surface of the upper outer tube part 23 (the circumferential wall). An upper end portion of the communication groove 29 communicates with the exhaust port 28. A lower end portion of the communication groove 29 at a lower end edge of the upper outer tube part 23 is opened. The circumferential wall of the upper outer tube part 23 penetrates a top wall of the lower outer tube part 24.

The inner tube 22 is fitted into the outer tube 21 from a lower side of the outer tube 21. The inner tube 22 is formed in a multi-stage tubular shape having parts whose diameter increases toward a lower side. Specifically, the inner tube 22 includes an upper inner tube part 31, and a lower inner tube part (a mounting tube) 32 extending downward from the upper inner tube part 31.

The upper inner tube part 31 is disposed coaxially with the upper outer tube part 23. The upper inner tube part 31 is fitted into the upper outer tube part 23 from a lower side of the upper outer tube part 23. An upper portion of the upper inner tube part 31 constitutes a small diameter part 34 having an outer diameter smaller than a lower portion of the upper inner tube part 31. A connection passage S1 is formed between the inner circumferential surface of the upper outer tube part 23 (the circumferential wall) and an outer circumferential surface of the small diameter part 34. The connection passage S1 connects the discharge port 26 and the supply port 27 to each other. An upper end edge of the small diameter part 34 is close to or in contact with a ceiling wall 23*a* of the upper outer tube part 23 from a lower side of the upper outer tube part 23.

Figure 4:
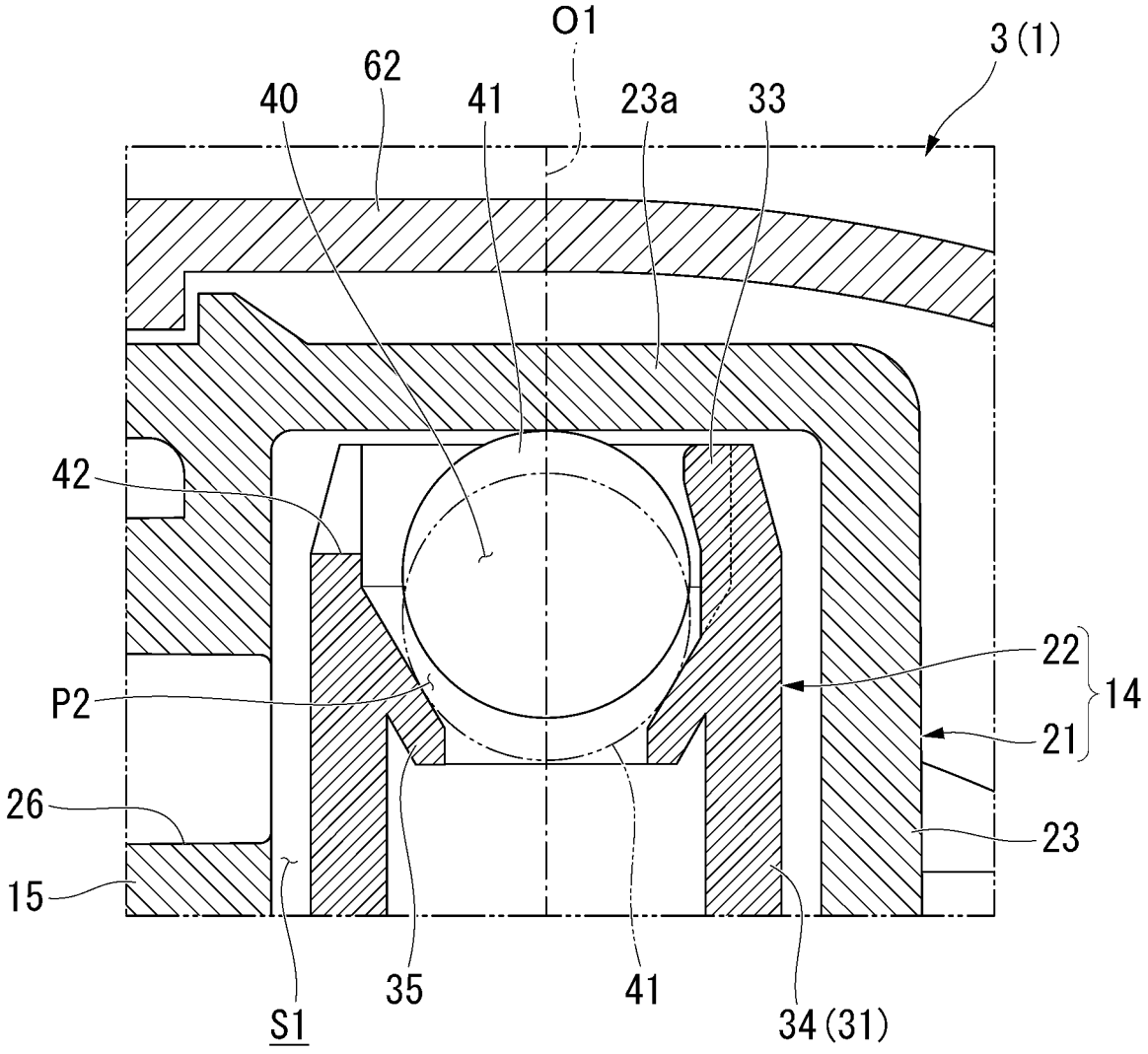
FIG. 4 is a cross-sectional view of a vertical supply pipe and an ejection barrel according to the first embodiment.

As shown in FIG. 4, an upper end portion of the small diameter part 34 has an outer diameter that gradually decreases toward an upper side. A rib 33 that protrudes inward in the radial direction is formed on the upper end portion of the small diameter part 34. The rib 33 extends in the upward/downward direction, and a plurality of the ribs 33 are formed at intervals in the circumferential direction.

A valve seat 35 that protrudes inward in the radial direction is provided on the small diameter part 34, and the valve seat 35 is positioned at a lower end portion of the rib 33. The valve seat 35 is formed in a tapered tubular shape that extends downward as it goes inward in the radial direction. An accommodation space 40 which accommodates a ball valve (a second switching valve) 41 is formed inside the inner tube 22 and defined by the small diameter part 34, the valve seat 35, and the ceiling wall 23*a* of the upper outer tube part 23. The ball valve 41 is configured to come in contact with and separate from the valve seat 35 due to the pressure inside the accommodation space 40 and its own weight. The ball valve 41 of the present embodiment is formed of a material that has a specific gravity larger than that of water or the liquid accommodated in the container body 2 and is capable of seating on the valve seat 35 by its own weight when the ejection container 1 is in the upright posture. Examples of the material preferably used for the ball valve 41 of the present embodiment include metal (for example, stainless steel). The ball valve 41 may be formed of a material (for example, glass) other than metal as long as it satisfies the above conditions.

The accommodation space 40 communicates with the connection passage S1 via a notch 42 formed in the upper end edge of the small diameter part 34. When the ball valve 41 seats on the valve seat 35, the accommodation space 40 blocks communication between the inside of the upper inner tube part 31 and the connection passage S1. When the ball valve 41 separates from the valve seat 35, the accommodation space 40 allows communication between the inside of the upper inner tube part 31 and the connection passage S1.

The lower inner tube part 32 is fitted into the lower outer tube part 24 from a lower side of the lower outer tube part 24. A through-hole 48 that passes through the top wall 45 of the lower inner tube part 32 in the upward/downward direction is formed in an inner circumferential portion of the top wall 45. A lower end portion (a portion protruding from the lower outer tube part 24) of the circumferential wall of the upper outer tube part 23 is inserted into the through-hole 48. The circumferential wall of the upper outer tube part 23 partitions an inside space of the through-hole 48 in the radial direction. An inner portion of the through-hole 48, which is positioned on an inner side in the radial direction with respect to the circumferential wall of the upper outer tube part 23, communicates with the inside of the communication groove 29. An outer portion of the through-hole 48, which is positioned on an outer side in the radial direction with respect to the circumferential wall of the upper outer tube part 23, communicates with an external air communication hole 82 (to be described below) via a space defined by the lower outer tube part 24 and the lower inner tube part 32.

An outward flange 51 which protrudes outward in the radial direction is formed on the circumferential wall of the lower inner tube part 32. In the present embodiment, for example, an axis (which is hereinafter referred to as "second axis O2") of the lower outer tube part 24 and the lower inner tube part 32 is eccentric forward with respect to the first axis O1.

The ejector body 10 includes a mounting cap 52 used for attaching the ejector 3 to the container body 2. The mounting cap 52 is formed in a tubular shape extending in the upward/downward direction. The mounting cap 52 is mounted (for example, screwed) on the mouth portion 2*a* in a state where the outward flange 51 of the lower inner tube part 32 is sandwiched between the mounting cap 52 and an upper end edge of the mouth portion 2*a*.

The ejection barrel 15 is formed integrally with the upper outer tube part 23. The ejection barrel 15 protrudes forward from an upper end portion of the upper outer tube part 23.

The inside of the ejection barrel 15 communicates with the connection passage S1 via the discharge port 26.

The trigger mechanism 16 includes a pump unit 61 having a cylinder 71 and a piston 72, a cover 62, a trigger 63, and an elastic plate 64.

The cylinder 71 has a bottomed tubular shape that opens forward. In the following description, a central axis of the cylinder 71 is referred to as a cylinder axis O3. The cylinder axis O3 extends in the forward/rearward direction.

The cylinder 71 includes a housing tube 77, a piston guide 78, and a bottom wall 79, the housing tube 77 and the piston guide 78 extend coaxially with the cylinder axis O3, and the bottom wall 79 connects a rear end edge of the housing tube 77 and a rear end edge of the piston guide 78 to each other.

The housing tube 77 is fitted into a tube portion 75 for a cylinder which is formed below the ejection barrel 15. An external air introduction hole 80 is formed in the housing tube 77, and external air is introduced into the container body 2 via the external air introduction hole 80 according to inflow of the liquid into the cylinder 71. The tube portion 75 for a cylinder is formed integrally with the vertical supply pipe 14 and the ejection barrel 15. The tube portion 75 for a cylinder opens forward, and a rear end opening of the tube portion 75 is closed by the upper outer tube part 23. Both end portions in the forward/rearward direction of the housing tube 77 come in close contact with an inner circumferential surface of the tube portion 75 for a cylinder. In a middle portion in the forward/rearward direction of the housing tube 77, an annular gap P1 is formed between an outer circumferential surface of the housing tube 77 and the inner circumferential surface of the tube portion 75 for a cylinder. The gap P1 communicates with the inside of the cylinder 71 via the external air introduction hole 80. The gap P1 communicates with the through-hole 48 via the external air communication hole 82 formed in the tube portion 75 for a cylinder.

A communication port 81 that communicates with the supply port 27 is formed in the bottom wall 79.

The piston guide 78 protrudes forward from an inner circumferential edge of the bottom wall 79. The piston guide 78 is formed in a topped tubular shape that opens rearward. A rear end opening of the piston guide 78 communicates with the exhaust port 28. A through-hole 83 that passes through a top wall of the piston guide 78 in the forward/rearward direction is formed in the top wall of the piston guide 78. A depression 84 which recesses inward in the radial direction of the cylinder axis O3 is formed in a rear end portion of the piston guide 78. The depression 84 is formed in the piston guide 78 throughout the circumference of the piston guide 78. The depression 84 may be formed intermittently.

The piston 72 is housed inside the housing tube 77 to be movable forward and rearward. The piston 72 includes a piston body 91, an inner sliding portion 92, and an outer sliding portion 93.

The piston body 91 is formed in a topped tubular shape that opens rearward. The piston guide 78 is inserted into the piston body 91.

The inner sliding portion 92 extends, from a rear end opening edge of the piston body 91, inward in the radial direction as it goes rearward. A rear end portion of the inner sliding portion 92 is configured to slide on an outer circumferential surface of the piston guide 78 according to forward and rearward movement of the piston 72. When the piston 72 reaches the most retracted position, the inner sliding portion 92 separates from the outer circumferential surface of the piston guide 78. Thereby, the inside of the piston body 91 and the inside of the cylinder 71 come in communication with each other via a space between the inner sliding portion 92 and the depression 84.

The outer sliding portion 93 is connected to a lower end portion of the piston body 91. The outer sliding portion 93 surrounds the piston body 91. The outer sliding portion 93 is formed in a tapered tubular shape whose diameter gradually increases, from a middle portion thereof in the forward/rearward direction, as it goes forward and rearward. Front and rear end portions of the outer sliding portion 93 are configured to slide on an inner circumferential surface of the housing tube 77 according to forward and rearward movement of the piston 72. When the piston 72 is at the frontmost position, the outer sliding portion 93 closes the external air introduction hole 80. As the piston 72 moves rearward, the outer sliding portion 93 opens the external air introduction hole 80.

The cover 62 covers the vertical supply pipe 14 and the ejection barrel 15 from an upper side, a rear side, and left and right sides.

The trigger 63 extends to curve forward as it goes downward. An upper end portion of the trigger 63 is linked to the ejection barrel 15 to be rotatable about an axis C1 extending in the leftward/rightward direction. A middle portion in the upward/downward direction of the trigger 63 is linked to a front end portion of the piston body 91 to be rotatable about an axis C2 extending in the leftward/rightward direction and to be movable in the upward/downward direction. The piston 72 moves forward and backward with respect to the cylinder 71 according to the rotational motion of the trigger 63 about the axis C1.

The elastic plate 64 is interposed between the ejection barrel 15 and the trigger 63. The elastic plate 64 biases the trigger 63 forward about the axis C1.

The nozzle 11 protrudes forward from the ejection barrel 15. The nozzle 11 includes a connecting member 100, a nozzle body 101, and an accumulator valve 102.

The connecting member 100 is formed in a topped tubular shape that opens rearward. A front end portion of the ejection barrel 15 is fitted into a circumferential wall of the connecting member 100. A communication hole 105 that passes through a front wall of connecting member 100 in the forward/rearward direction is formed in the front wall of connecting member 100. The communication hole 105 communicates with the inside of the ejection barrel 15 via a front end opening portion 15*a* of the ejection barrel 15.

A fitting tube 110 is formed on the front wall of the connecting member 100. The fitting tube 110 is formed in a tubular shape extending forward and is eccentric downward with respect to an axis of the ejection barrel 15.

The nozzle body 101 is formed in a topped tubular shape that opens rearward. The fitting tube 110 is fitted into a circumferential wall of the nozzle body 101. A space defined by the connecting member 100 and the nozzle body 101 constitutes an accumulator chamber 115.

A nozzle cap 112 having an ejection hole 112*a* is mounted on a front wall of the nozzle body 101.

The accumulator valve 102 is accommodated in the accumulator chamber 115 to be movable rearward in a state where the accumulator valve 102 is biased forward by a coil spring 120. The accumulator valve 102 seats on a valve seat 121 formed on the front wall of the nozzle body 101 to close the ejection hole 112*a*. A small diameter piston portion 102*a* is formed in a rear half portion of the accumulator valve 102, and a large diameter piston portion 102*b* is formed in a front half portion of the accumulator valve 102. The accumulation valve 102 is configured such that the pressure of the liquid introduced into the accumulation chamber 115 via the communication hole 105 is applied to both piston portions 102*a* and 102*b*. When this pressure is equal to or more than a predetermined value, due to the difference in pressure receiving area between the piston portions 102*a* and 102*b*, the accumulator valve 102 is moved rearward to open the ejection hole 112*a*.

The trigger type liquid ejector 3 of the present embodiment includes a lid 130 as a blocking member configured to block communication between the inside of the nozzle 11 and the outside via the ejection hole 112*a*. The lid 130 is provided at the nozzle 11, and closes the ejection hole 112*a* so as to be capable of opening and closing the ejection hole 112*a* from the front. An upper end portion of the lid 130 is mounted on the front wall of the nozzle body 101 to be rotatable about an axis extending in the leftward/rightward direction. The blocking member is not limited to the lid 130, and for example, a configuration in which communication between the inside of the nozzle body 101 and the outside via the ejection hole 112*a* is blocked by relatively rotating the nozzle body 101 with respect to the connecting member 100 may be employed.

The upright and inverted posture adaptor 12 is mounted on a lower end portion of the vertical supply pipe 14. The upright and inverted posture adaptor 12 enables the ejection container 1 in both of the upright posture (a posture in which the mouth portion 2*a* is directed upward) and the inverted posture (a posture in which the mouth portion 2*a* is directed downward) to eject the liquid in the container body 2.

The upright and inverted posture adaptor 12 includes a first fitting member 140, a second fitting member 141, and a partition member 142, the first fitting member 140 and the second fitting member 141 are assembled in the upward/downward direction, and the partition member 142 partitions a space between the first fitting member 140 and the second fitting member 141. The first fitting member 140, the second fitting member 141, and the partition member 142 constitute an adaptor body of the present embodiment.

The first fitting member 140 is formed in a multi-stage tubular shape having parts whose diameter decreases toward an upper side. Specifically, the first fitting member 140 includes a small diameter part 145, a middle diameter part 146, and a large diameter part 147.

The small diameter part 145 is disposed coaxially with the first axis O1. An upper portion of the small diameter part 145 is fitted into the upper inner tube part 31. A first flange 150 that protrudes outward in the radial direction is formed on the small diameter part 145, and the first flange 150 is positioned above a lower end edge of the small diameter part 145.

The middle diameter part 146 extends downward from an outer circumferential edge of the first flange 150. The middle diameter part 146 is disposed coaxially with the second axis O2. The middle diameter part 146 is fitted into the lower inner tube part 32 from a lower side of the lower inner tube part 32. Thereby, a lower end opening of the lower inner tube part 32 is closed. A second flange 152 that protrudes outward in the radial direction is formed on a lower end edge of the middle diameter part 146. The second flange 152 is close to or in contact with a lower end edge of the lower inner tube part 32 from a lower side of the lower inner tube part 32.

The large diameter part 147 extends downward from an outer circumferential edge of the second flange 152. An inverted posture introduction port 153 that passes through the large diameter part 147 in the radial direction is formed in a front portion (a portion positioned on a front side of the second axis O2) of the large diameter part 147.

The partition member 142 includes a first communication tube 160 and a second communication tube 161.

The first communication tube 160 is disposed coaxially with the first axis O1. A lower end portion (a portion protruding downward from the first flange 150) of the small diameter part 145 is fitted into the first communication tube 160 from an upper side of the first communication tube 160.

The second communication tube 161 is connected to the front of the first communication tube 160. The second communication tube 161 has a diameter that gradually decreases toward a lower side. In the present embodiment, a space defined by the second communication tube 161 and the first fitting member 140 constitutes a valve chamber (a second space) 165. The valve chamber 165 communicates with the inside of the container body 2 via the inverted posture introduction port 153. A ball valve (a first switching valve) 164 is accommodated in the valve chamber 165. As the ball valve 164 comes in contact with and separates from a lower end opening edge of the second communication tube 161, the ball valve 164 opens and closes a lower end opening of the second communication tube 161.

The second fitting member 141 includes a blocking portion 170 and a fixing tube 171.

The blocking portion 170 is formed in a bottomed tubular shape that opens upward. The blocking portion 170 is fitted into the large diameter part 147 in a state where the partition member 142 is sandwiched between the blocking portion 170 and the large diameter part 147.

The fixing tube 171 passes through a bottom wall of the blocking portion 170 in a rear portion (at a position coaxially with the first axis O1) of the blocking portion 170. A suction pipe 175 is fitted into a lower portion of the fixing tube 171. An upper end opening (an upright posture introduction port) 171*a* of the fixing tube 171 communicates with the inside of the first communication tube 160. Therefore, the first communication tube 160 communicates with the inside of the container body 2 via the fixing tube 171. The second communication tube 161 communicates with the inside of the container body 2 via the inverted posture introduction port 153.

A space defined by the blocking portion 170, the fixing tube 171 and the second communication tube 161 constitutes a connection flow path 180 that connects the valve chamber 165 and the fixing tube 171 to each other. The connection flow path 180 communicates with the inside of the fixing tube 171 via a slit 182 formed in the fixing tube 171. A space extending from the connection flow path 180 to the small diameter part 145 via the slit 182 constitute a first space of the present embodiment.

Here, in the present embodiment, a flow path extending through the through-hole 83 of the piston guide 78, the inside of the piston guide 78, the exhaust port 28, the communication groove 29, and the through-hole 48 constitutes a recovery passage S2 that is configured to return air bubbles and the like remaining in the cylinder 71 to the inside of the container body 2. The recovery passage S2 communicates, via the through-hole 48, with an intermediate space S3 defined by the lower inner tube part 32 and the first fitting member 140.

Figure 2:
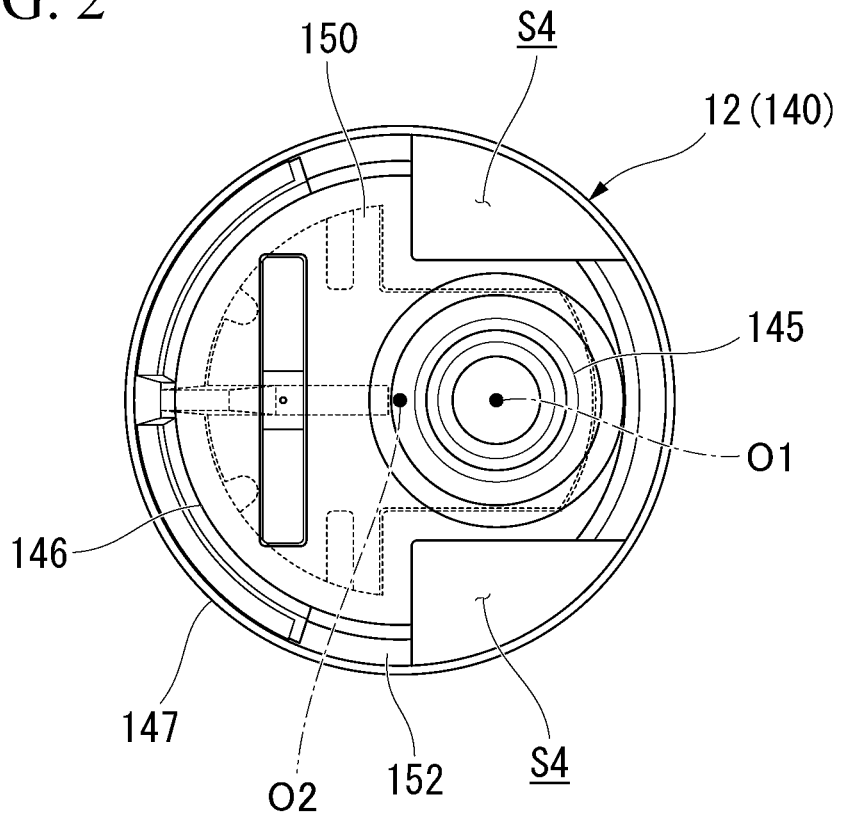
FIG. 2 is a plan view of an upright and inverted posture adaptor according to the first embodiment.
Figure 3:
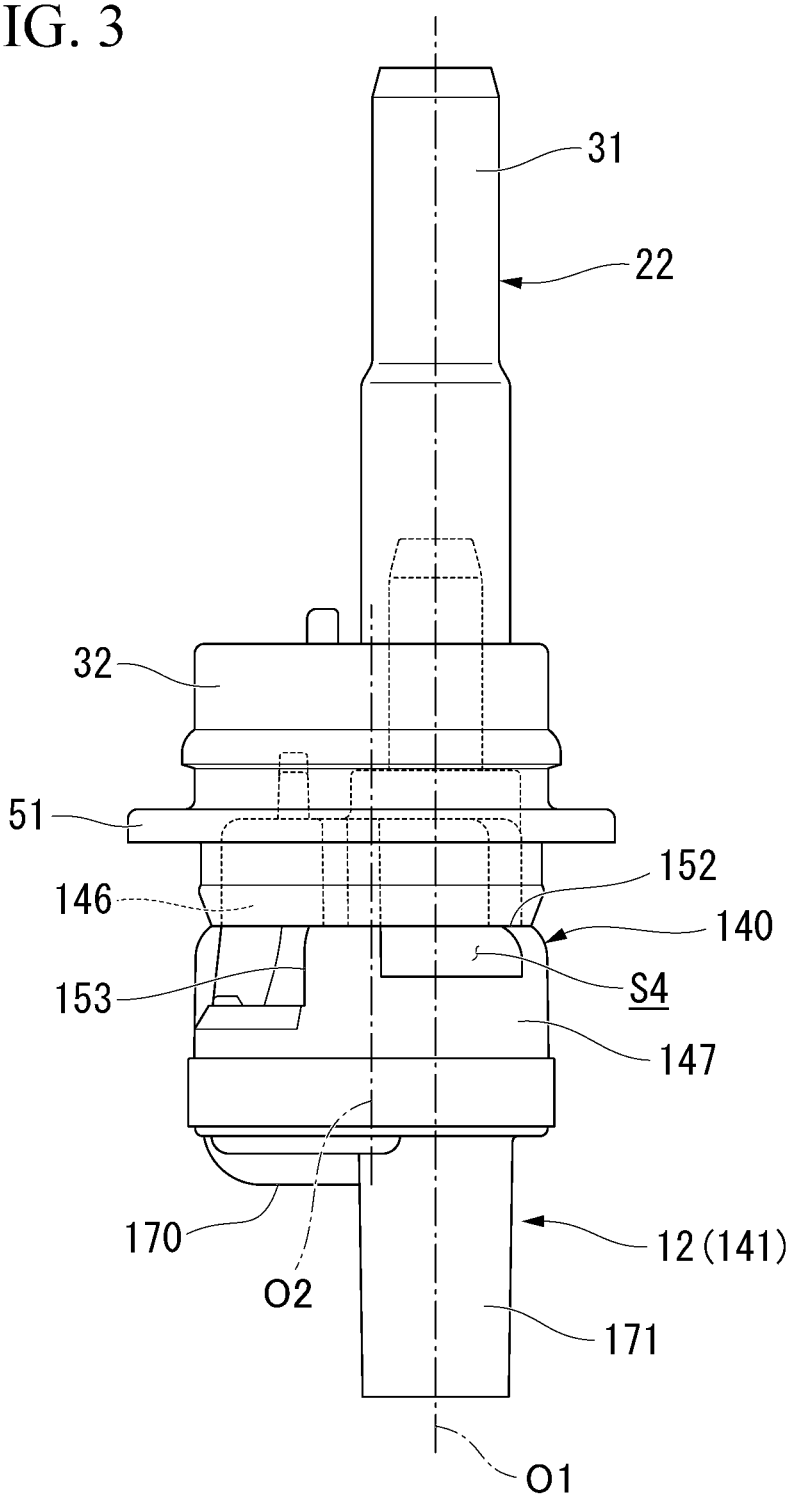
FIG. 3 is a side view of the upright and inverted posture adaptor and an inner tube according to the first embodiment.

As shown in FIGS. 2 and 3, a communication passage S4 that is configured to bring the intermediate space S3 in communication with the inside of the container body 2 is formed in the first fitting member 140. The communication passage S4 is formed by recessing the middle diameter part 146, the large diameter part 147, the first flange 150 and the second flange 152. Specifically, the communication passages S4 are formed on both right and left sides of the small diameter part 145, and each communication passage S4 is disposed rearward with respect to the second axis O2 (the center in the forward/rearward direction of the upright and inverted posture adaptor 12). Each communication passage S4 opens upward, rearward, and outward in the radial direction. A lower end portion of the communication passage S4 is disposed below the lower inner tube part 32 and communicates with the inside of the container body 2.

In the present embodiment, the minimum value of the flow passage cross-sectional area (cross-sectional area perpendicular to an opening direction) of the communication passage S4 is larger than the minimum value of the flow passage cross-sectional area of the recovery passage S2. The minimum value of the flow passage cross-sectional area of the recovery passage S2 is the minimum valve among the flow passage cross-sectional areas perpendicular to the opening direction of the through-hole 83 of the piston guide 78, the inside of the piston guide 78, the exhaust port 28, the communication groove 29, and the through-hole 48. In the present embodiment, the minimum value of the flow passage cross-sectional area of the communication passage S4 is set to be larger than air bubbles generated in the cylinder 71.

When the ball valve 41 seats on the valve seat 35, the accommodation space 40 blocks communication between the inside of the upper inner tube part 31 (a portion below the accommodation space 40) and the connection passage S1. As shown in FIG. 4, when the ball valve 41 separates from the valve seat 35, a gap between an inner circumferential surface of the valve seat 35 and the ball valve 41 is formed in the accommodation space 40. Accordingly, the inside of the upper inner tube part 31 comes in communication with the connection passage S1 via the gap P2.

Here, the cross-sectional area of the gap P2 when the ball valve 41 is in contact with the ceiling wall 23*a* of the upper outer tube part 23 at a position on the axis O1 is denoted by D1. That is, the cross-sectional area D1 is a flow passage cross-sectional area of an annular space (the gap P2) formed between the ball valve 41 and the valve seat 35, in a direction perpendicular to a seat surface (a contact surface with the ball valve 41) of the valve seat 35 when seen from a vertical cross-sectional view along the upward/downward direction. In the present embodiment, the cross-sectional area D1 is preferably set to 1.7 $mm^2 \leq D1 \leq 10.0\ mm^2$, and is more preferably set to 34 $mm^2 \leq D1 \leq 6.9\ mm^2$ In the ejector 3 of the present embodiment, the cross-sectional area D1 is 1.7 $mm^2$ when the movement amount of the ball valve 41 (the movement amount of the ball valve 41 from a state of seating on the valve seat 35 to a state of coming in contact with the ceiling wall 23*a*) is 0.3 mm, and the cross-sectional area D1 is 10.0 $mm^2$ when the movement amount is 1.5 mm.

The opening area (the minimum opening area) of a lower end opening portion of the valve seat 35 is denoted by D2. In the present embodiment, the diameter φ of the lower end opening portion of the valve seat 35 is set to 2.8 mm.

In this case, in the present embodiment, the relationship of the cross-sectional area D1 with respect to the opening area D2 satisfies the following condition.

$$0.62 \leq D2/D1 \leq 3.62 \quad (1)$$

In the present embodiment, the minimum cross-sectional area D3 of the discharge port 26 is set to 5.31 $mm^2$. In this case, the relationship of the cross-sectional area D1 with respect to the minimum cross-sectional area D3 satisfies the following condition.

$$0.53 \leq D3/D1 \leq 3.1 \quad (2)$$

By setting D3/D1 to equal to or more than 0.53, during the ejection operation in the inverted posture, it is possible to increase the flow amount of the liquid flowing into the ejection barrel 15, among the liquid flowing in the connection passage S1, as compared with the flow amount of the liquid passing through the gap P2. As a result, it is possible to suppress the variation in the ejection amount of the ejector 3 between the upright posture and the inverted posture.

By setting D3/D1 to equal to or less than 3.1, the liquid can be efficiently introduced into the cylinder 71. It is more preferable that $0.77 \leq D3/D1 \leq 1.5$ is satisfied in order to exert the effects described above.

Next, the operation of the ejection container 1 will be described. First, the ejection operation in the upright posture will be described. When the ejection container 1 is in the upright posture, the ball valve 41 seats on the valve seat 35 due to its own weight, and the ball valve 164 seats on the lower end opening edge of the second communication tube 161 due to its own weight. That is, the ball valve 164 blocks communication between the first space and the valve chamber 165 when the container body 2, on which the ejector body 10 is mounted, is upright.

When the ejection container 1 is in the upright posture, in order to eject the liquid in the container body 2, the trigger 63 is pulled rearward against a biasing force of the elastic plate 64. The piston 72 is moved rearward according to rearward movement of the trigger 63, and therefore the inside of the cylinder 71 is pressurized. As the inside of the cylinder 71 is pressurized, the liquid in the cylinder 71 flows into the accommodation space 40 via the connection passage S1, and thereby the ball valve 41 is pressed against the valve seat 35. Accordingly, communication between the inside of the container body 2 and the connection passage S1 is blocked. As a result, the liquid in the cylinder 71 is introduced into the ejection barrel 15 via the connection passage S1. As the liquid is introduced into the ejection barrel 15, the inside of the ejection barrel 15 is pressurized. As a result, the insides of the small diameter piston portion 102*a* and the large diameter piston portion 102*b* in the accumulator valve 102 are pressurized through the communication hole 105.

In the present embodiment, the inner diameter of the large diameter piston portion 102*b* is larger than the inner diameter of the small diameter piston portion 102*a*. Therefore, due to the difference in pressure receiving area between the small diameter piston portion 102*a* and the large diameter piston portion 102*b*, pressure directed rearward is applied to the accumulator valve 102. When the pressure in the small diameter piston portion 102*a* and the large diameter piston portion 102*b* is equal to or more than a predetermined value, the accumulator valve 102 is moved rearward against a forward biasing force by the coil spring 120. As a result, a front end portion of the accumulator valve 102 is separated from the valve seat 121, and thereby the inside of the ejection barrel 15 comes in communication with the ejection hole 112*a* via the communication hole 105, the inside of the accumulator valve 102, and a gap between the front end portion of the accumulator valve 102 and the valve seat 121. Accordingly, the liquid is ejected from the ejection hole 112*a*.

When the operation of pulling the trigger 63 is stopped, the supply of the liquid from the cylinder 71 into the ejection barrel 15 via the connection passage S1 of the vertical supply pipe 14 is stopped. At this time, as the accumulator valve 102 is moved forward due to the forward biasing force by the coil spring 120, the front end portion of the accumulator valve 102 seats on the valve seat 121, and communication between the inside of the ejection barrel 15 and the ejection hole 112*a* is blocked.

The trigger 63 is biased forward to return to its original position by the elastic recovering force of the elastic plate 64. As the piston 72 is moved forward according to forward movement of the trigger 63, the pressure in the cylinder 71 becomes a negative pressure. At this time, due to the negative pressure in the cylinder 71, the liquid in the container body 2 flows into the upright and inverted posture adaptor 12 via the suction pipe 175. The liquid flowing into the upright and inverted posture adaptor 12 flows through the inside of the inner tube 22 and pushes up the ball valve 41. Accordingly, the ball valve 41 is separated from the valve seat 35, and the liquid is introduced into the cylinder 71 via the connection passage S1 and the communication port 81 (the supply port 27). Accordingly, the liquid can be provided upon the next ejection.

Next, the ejection operation in the inverted posture will be described. When the ejection container 1 is in the inverted posture, the ball valve 41 separates from the valve seat 35 due to its own weight, and the ball valve 164 separates from the lower end opening edge of the second communication tube 161 due to its own weight. That is, the ball valve 164 allows communication between the first space and the valve chamber 165 when the container body 2, on which the ejector body 10 is mounted, is inverted.

When the ejection container 1 is in the inverted posture, as the trigger 63 is pulled rearward, the inside of the cylinder 71 is pressurized. As a result, the liquid in the cylinder 71 and the connection passage S1 is introduced into the ejection barrel 15 and the accommodation space 40. Here, the gap P2 between the ball valve 41 and the valve seat 35 is formed such that the flow resistance of the liquid passing through the ejection barrel 15 is smaller than the flow resistance of the liquid passing through the gap P2. As a result, the liquid is positively introduced into the ejection barrel 15 and is ejected from the ejection hole 112*a* as is described above.

When the trigger 63 returns forward after the liquid is ejected, similar to the case of the upright posture, the pressure in the cylinder 71 becomes a negative pressure. As a result, the liquid flowing into the valve chamber 165 via the inverted posture introduction port 153 flows into the first communication tube 160 via the lower end opening of the second communication tube 161, the connection flow path 180, and the slit 182. The liquid flowing into the first communication tube 160 flows through the inside of the inner tube 22, and then is introduced into the cylinder 71 via the connection passage S1 and the communication port 81 (the supply port 27). Accordingly, the liquid can be provided upon the next ejection.

Here, in the ejection container 1, for example when the remaining amount of the liquid in the container body 2 gets fewer, there is a possibility that air may enter the cylinder 71 together with the liquid. The air entering in the cylinder 71 tends to remain in the cylinder 71 as air bubbles, which may cause ejection failure.

In the present embodiment, when the trigger 36 is moved to the most retracted position, the inside of the piston body 91 comes in communication with the inside of the cylinder 71 via the space between the inner sliding portion 92 and the depression 84. As a result, air bubbles remained in the cylinder 71 flows into the piston body 91 via the space between the inner sliding portion 92 and the depression 84. The air bubbles flowing into the piston body 91 are discharged from the piston body 91 by passing through the recovery passage S2 (the flow path extending through the through-hole 83, the inside of the piston guide 78, the exhaust port 28, the communication groove 29, and the through-hole 48). The air bubbles passing through the recovery passage S2 reach the intermediate space S3 and then are discharged into the container body 2 via the communication passage S4.

The trigger type liquid ejector 3 according to the present embodiment includes the ejector body 10 mounted on the container body 2 in which the liquid is accommodated, and the nozzle 11 disposed in front of the ejector body 10 and in which the ejection hole 112*a* configured to eject the liquid is formed. The ejector body 10 includes the vertical supply pipe 14, the ejection barrel 15, the trigger 63, the piston 72, and the cylinder 71, the vertical supply pipe 14 extends in the upward/downward direction and is configured to suction the liquid in the container body 2, the ejection barrel 15 is disposed in front of the vertical supply pipe 14 and is configured to guide the liquid in the vertical supply pipe 14 to the ejection hole 112*a*, the trigger 63 is disposed in front of the vertical supply pipe 14 to be movable rearward in a state where the trigger 63 is biased forward, the piston 72 has the piston body 91 which is formed in a tubular shape and to which the trigger 63 is linked, and the inner sliding portion 92 and the outer sliding portion 93 which are connected to the piston body 91, the piston 72 is configured to move forward and rearward according to forward and rearward movement of the trigger 63, the cylinder 71 has the piston guide 78 which is inserted into the piston body 91, and the inside of the cylinder 71 is pressurized and depressurized by the inner sliding portion 92 and the outer sliding portion 93 sliding on the cylinder 71 according to forward and rearward movement of the piston 72. The recovery passage S2 is formed in the ejector body 10 and is configured to bring the inside of the cylinder 71 in communication with the inside of the vertical supply pipe 14 via the space between the piston body 91 and the piston guide 78. The vertical supply pipe 14 has the lower inner tube part 32 into which the recovery passage S2 opens. The trigger type liquid ejector 3 includes the upright and inverted posture adaptor 12 which is attached into the lower inner tube part 32 in a state where communication between the recovery passage S2 and the inside of the container body 2 is blocked. The upright and inverted posture adaptor 12 has the first fitting member 140, the second fitting member 141, the partition member 142, and the ball valve 164, the first fitting member 140, the second fitting member 141, and the partition member 142 define the first space which is configured to bring the inside of the container body 2 in communication with the inside of the vertical supply pipe 14 via the upper end opening 171*a*, and the valve chamber 165 which is configured to bring the inside of the container body 2 in communication with the first space via the inverted posture introduction port 153, and the ball valve 164 is configured to block communication between the first space and the valve chamber 165 when the container body 2, on which the ejector body 10 is mounted, is upright, and is configured to allow communication between the first space and the valve chamber 165 when the container body 2, on which the ejector body 10 is mounted, is inverted. The communication passage S4 is formed between the outer circumferential surface of the upright and inverted posture adaptor 12 and the inner circumferential surface of the lower inner tube part 32, and is configured to bring the recovery passage S2 in communication with the inside of the container body 2. The minimum value of the flow passage cross-sectional area of the communication passage S4 is larger than the minimum value of the flow passage cross-sectional area of the recovery passage S2.

In the present embodiment, the upright and inverted posture adaptor 12 is attached into the lower end portion of the vertical supply pipe 14 in a state where communication between the recovery passage S2 and the inside of the container body 2 is blocked, and the communication passage S4 that is configured to bring the recovery passage S2 in communication with the inside of the container body 2 is formed between the upright and inverted posture adaptor 12 and the vertical supply pipe 14.

According to this configuration, air bubbles discharged from the cylinder 71 into the recovery passage S2 pass through the communication passage S4 and are discharged into the container body 2. As a result, it is possible for the ejection container 1 to eject the liquid in the container body 2 in both of the upright and inverted postures, and it is possible to suppress dripping of the liquid via the external air introduction hole 80 or the like due to air bubbles filled inside the recovery passage S2.

Particularly, in the present embodiment, as the minimum value of the flow passage cross-sectional area of the communication passage S4 is larger than the minimum value of the flow passage cross-sectional area of the recovery passage S2, air bubbles can be efficiently discharged into the container body 2.

Further, particularly in the ejector 3 having the accumulator valve 102, when priming (an operation of discharging air from the cylinder 71 and introducing liquid into the cylinder 71) is performed, there is a possibility that air discharged from the cylinder 71 does not completely go out from the ejection hole 112*a*, and may wander between the inside of the cylinder 71 and the inside of the vertical supply pipe 14 or the inside of the ejection barrel 15. In this case, it may be difficult to smoothly introduce the liquid into the cylinder 71.

In the present embodiment, even in this case, by moving the trigger 63 to the most retracted position to bring the inside of the piston body 91 in communication with the inside of the cylinder 71, air in the cylinder 71 is discharged into the container body 2 via the recovery passage S2, the intermediate space S3, and the communication passage S4. Accordingly, it becomes easier to discharge the air from the cylinder 71 at the time of the priming, and the liquid can be smoothly introduced into the cylinder 71.

In the present embodiment, the nozzle 11 includes the accumulator valve 102 that is disposed to be movable rearward in a state where the accumulator valve 102 is biased forward, and is configured to openably close the front end opening portion 15*a* of the ejection barrel 15.

With this configuration, when the pressure acting on the accumulator valve 102 is equal to or more than a predetermined value, the accumulator valve 102 allows communication between the ejection hole 112*a* and the inside of the ejection barrel 15, and accordingly, it is possible to secure the ejection pressure of the liquid ejected from the ejection hole 112*a*.

Further, even if air bubbles or liquid that cannot be ejected from the ejection hole 112*a* remains in the cylinder 71 when the pressure acting on the accumulator valve 102 is less than the predetermined value, the air bubbles or liquid remaining in the cylinder 71 can be returned into the container body 2 via the recovery passage S2 and the communication passage S4. Accordingly, it is possible to suppress dripping of liquid while stabilizing the ejection operation.

In the present embodiment, the inverted posture introduction port 153 is disposed forward with respect to the second axis O2, and the communication passage S4 is disposed rearward with respect to the second axis O2.

With this configuration, the inverted posture introduction port 153 and the communication passage S4 are separated from each other in the forward/rearward direction. Accordingly, for example at the time of the ejection operation in the inverted posture, it is possible to easily suppress the air bubbles discharged from the communication passage S4 from flowing again into the cylinder 71 via the inverted posture introduction port 153.

In the present embodiment, the relationship of the cross-sectional area D1 with respect to the opening area D2 is set that $0.62 \leq D2/D1 \leq 3.62$.

With this configuration, by setting D2/D1 to equal to or more than 0.62, the cross-sectional area D1 can be made relatively small. This makes it difficult for the liquid flowing in the connection passage S1 to pass through the gap P2 between the ball valve 41 and the valve seat 35 at the time of the ejection operation in the inverted posture. That is, by making the flow of the liquid into the ejection barrel 15 dominant, among the liquid flowing in the connection passage S1, as compared with the flow of the liquid through the gap P2, the liquid can be efficiently introduced into the ejection barrel 15. As a result, it is possible to suppress the variation in the ejection amount of the ejector 3 between the upright posture and the inverted posture.

By setting D2/D1 to equal to or less than 3.62, it is possible to set the size of the gap P2 such that the liquid suctioned from the container body 2 when the pressure in the cylinder 71 becomes a negative pressure can pass through the gap P2. Thereby, the piston 72 can be smoothly moved, and therefore the liquid can be efficiently introduced into the cylinder 71 and the operability of the trigger 63 can be improved.

Further, in the present embodiment, the cross-sectional area D1 is set that $1.7\ mm^2 \leq D1 \leq 10.0\ mm^2$.

With this configuration, by setting D1 to equal to or less than 100 $mm^2$, the cross-sectional area D1 can be made relatively small. Accordingly, it is possible to secure the ejection amount of the ejector 3 in the inverted posture, and it is possible to suppress the variation in the ejection amount of the ejector 3 between the upright posture and the inverted posture.

By setting D1 to equal to or more than 1.7 $mm^2$, the liquid can be efficiently introduced into the cylinder 71 when the pressure in the cylinder 71 becomes a negative pressure, and the operability of the trigger 63 can be improved.

In the present embodiment, the specific gravity of the ball valve 41 is larger than that of water.

With this configuration, the ball valve 41 can reliably seat on the valve seat 35 at the time of the upright posture. Thereby, the ejection amount of the ejector 3 in the upright posture can be stabilized.

Second Embodiment

Next, a second embodiment according to the present invention will be described.

Figure 5:
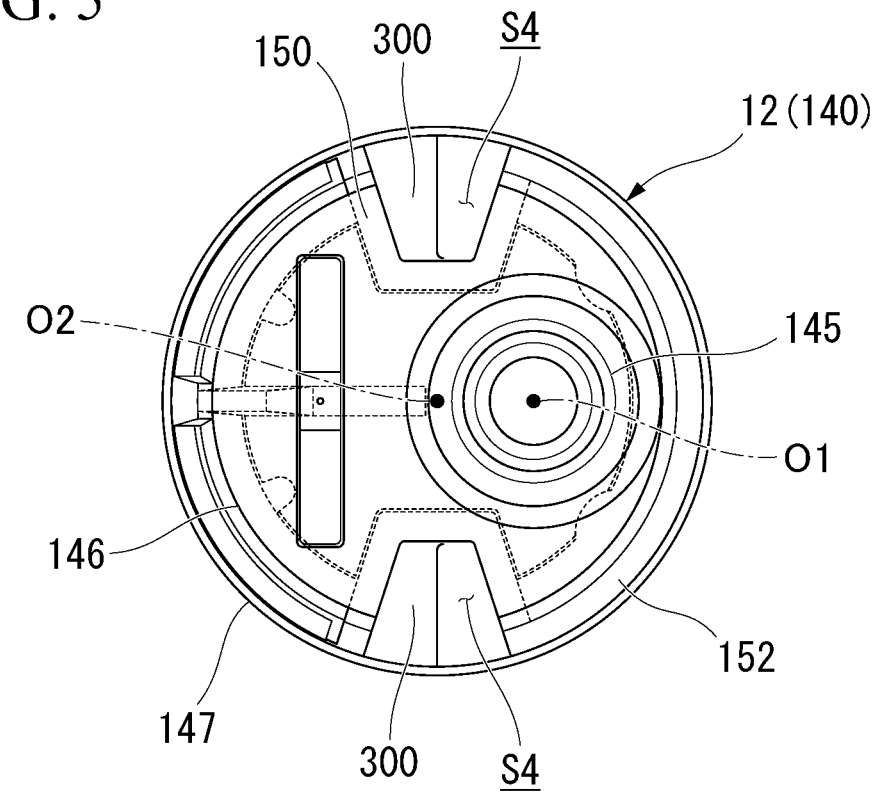
FIG. 5 is a plan view of an upright and inverted posture adaptor according to a second embodiment.
Figure 6:
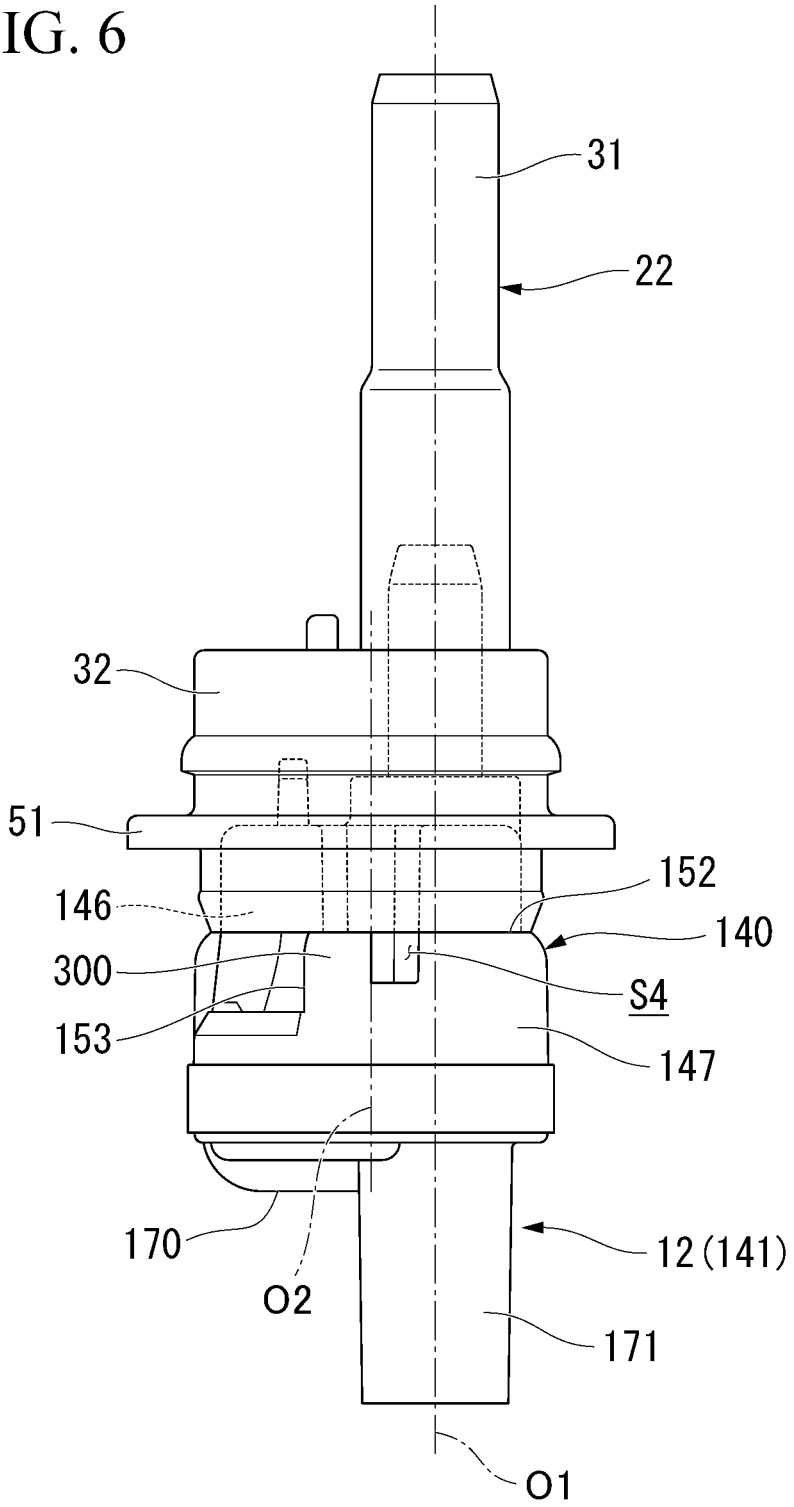
FIG. 6 is a side view of the upright and inverted posture adaptor and an inner tube according to the second embodiment.

As shown in FIGS. 5 and 6, in the present embodiment, the communication passages S4 are formed in the first fitting member 140 on left and right sides with respect to the second axis O2. Each communication passage S4 is formed in a fan shape whose width gradually increases toward an outer side (a direction away from the second axis O2) in the leftward/rightward direction. Each communication passage S4 opens upward and outward in the leftward/rightward direction.

A partition wall 300 that bulges upward from a bottom wall of the communication passage S4 is formed on a front half portion of the communication passage S4. The partition wall 300 is formed flush with the second flange 152 and the large diameter part 147. An upper end surface of the partition wall 300 and the second flange 152 are close to or in contact with the lower end edge of the lower inner tube part 32 from a lower side of the lower inner tube part 32. The partition wall 300 may be positioned inside the second flange 152 and the large diameter part 147.

According to this configuration, the same effects as those of the above-described embodiment are exhibited, and the following effects are further exhibited.

Since the partition wall 300 is disposed between the communication passage S4 and the inverted posture introduction port 153, even when the distance between the communication passage S4 and the inverted posture introduction port 153 becomes smaller, it is possible to suppress air bubbles discharged from the communication passage S4 from flowing into the inverted posture introduction port 153.

Figure 7:
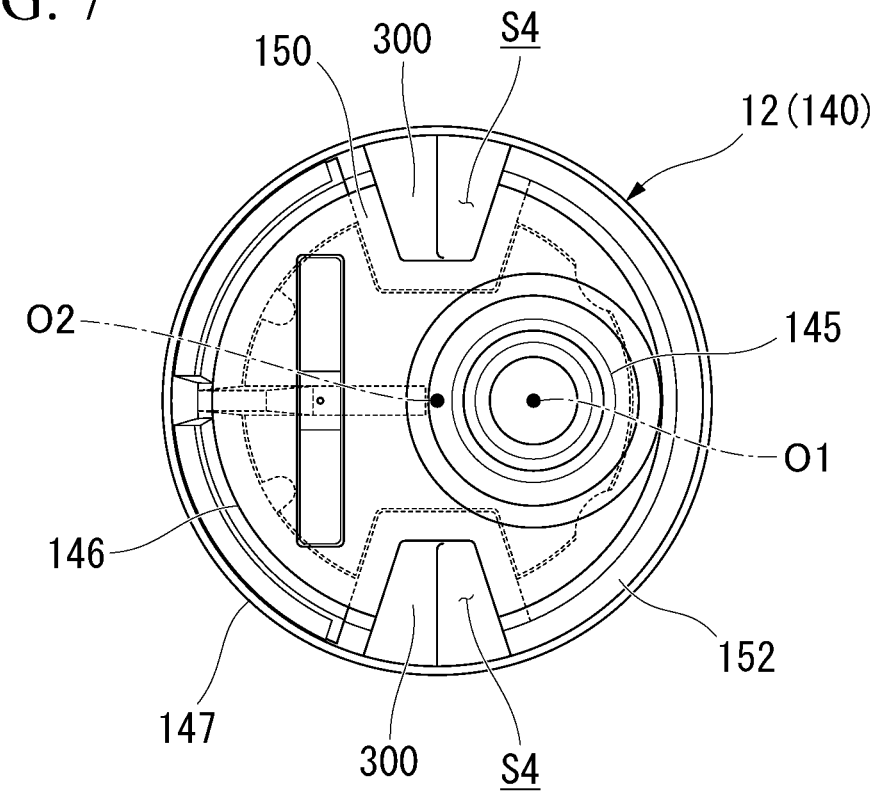
FIG. 7 is a plan view of an upright and inverted posture adaptor according to a modified example of the second embodiment.
Figure 8:
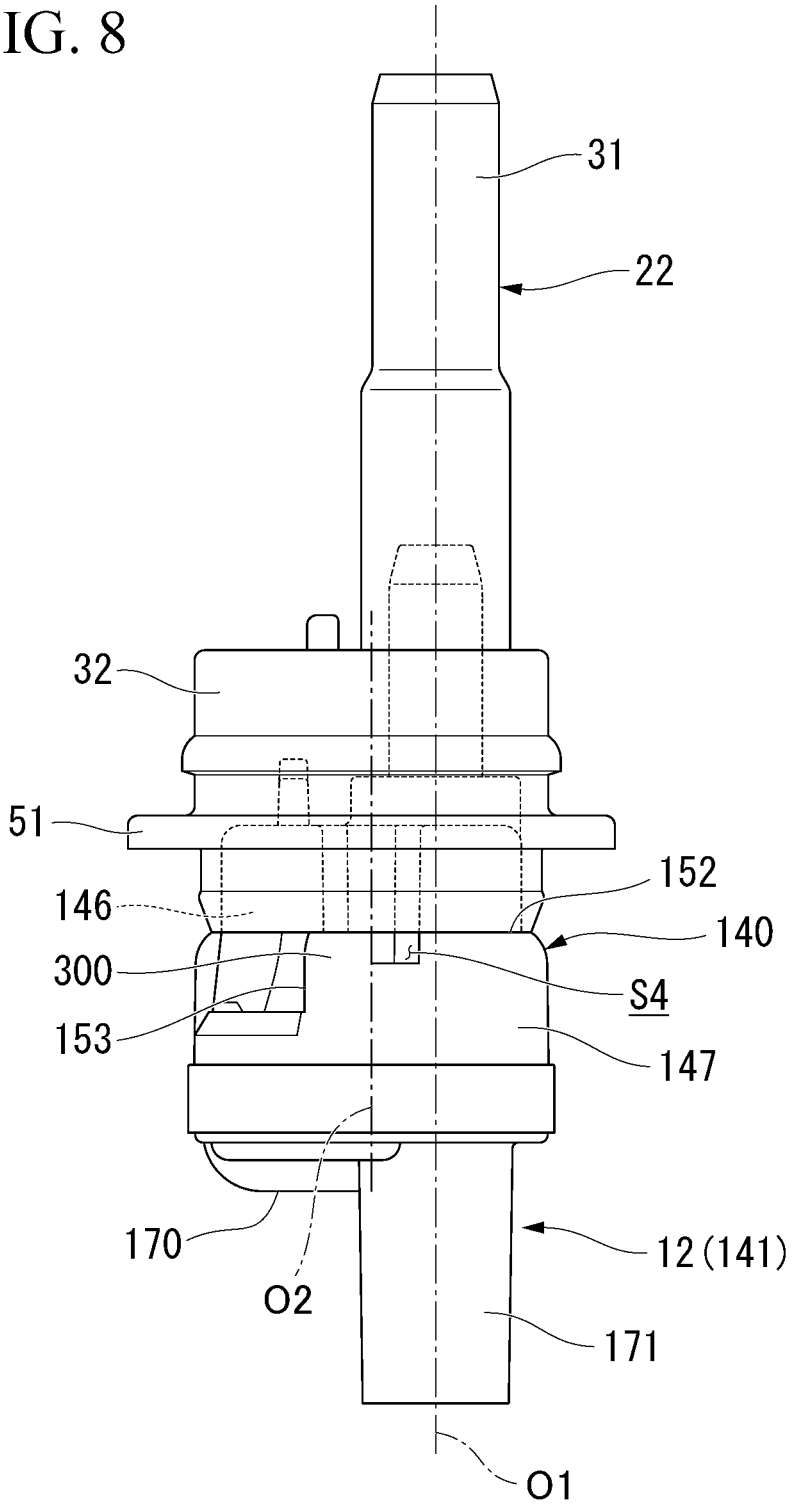
FIG. 8 is a side view of the upright and inverted posture adaptor and an inner tube according to the modified example of the second embodiment.

Note that, as shown in FIGS. 7 and 8, the height of the bottom wall of the communication passage S4 can be appropriately changed as long as at least a portion of the communication passage S4 communicates with the inside of the container body 2.

Figure 9:
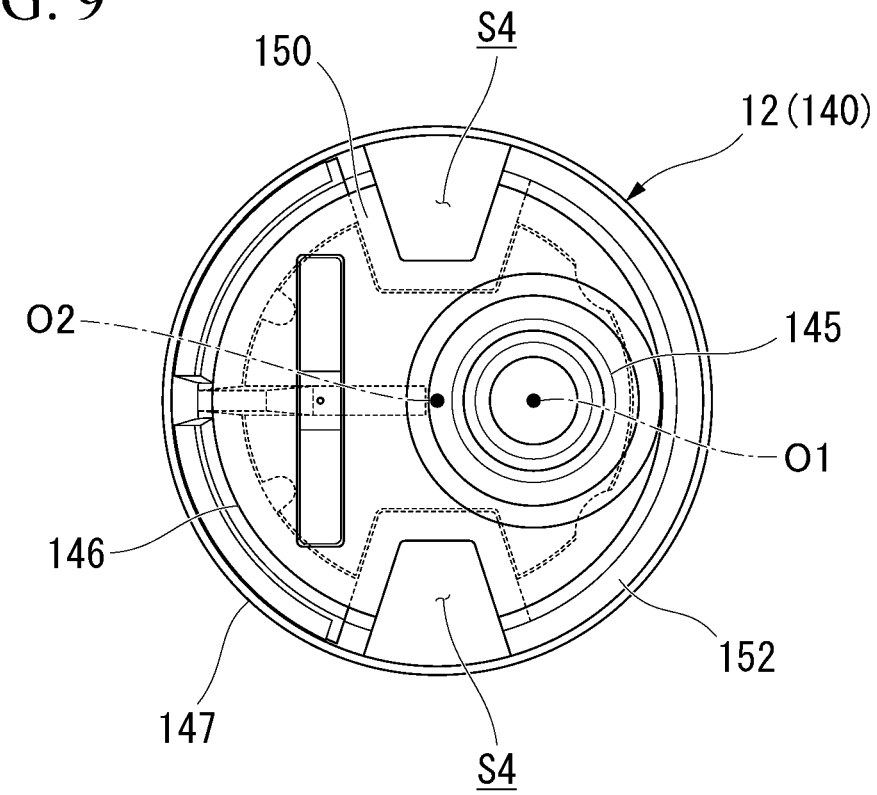
FIG. 9 is a plan view of an upright and inverted posture adaptor according to another modified example of the second embodiment.
Figure 10:
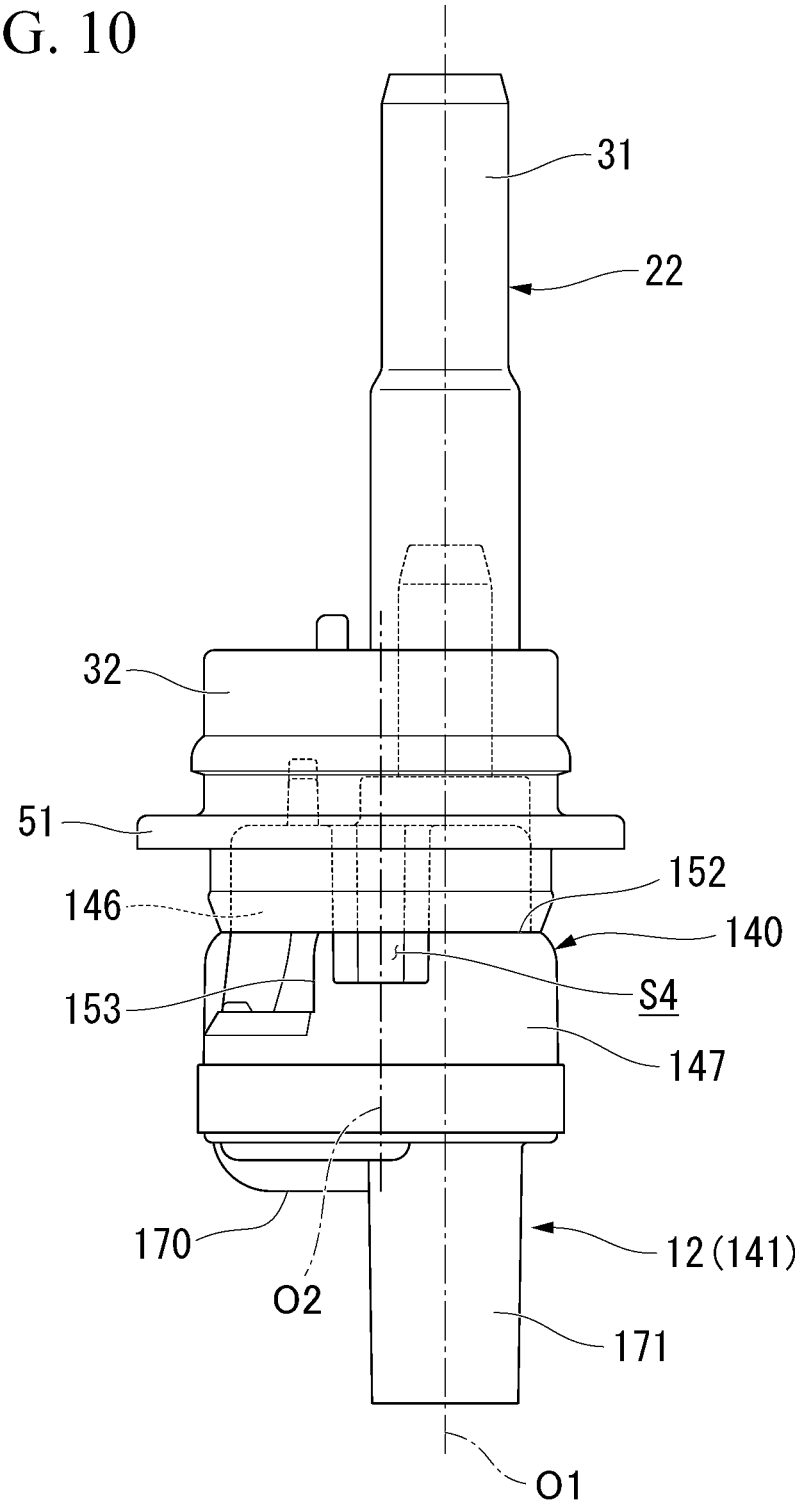
FIG. 10 is a side view of the upright and inverted posture adaptor and an inner tube according to the modified example of the second embodiment.

Further, in the above embodiment, the configuration in which the partition wall 300 is provided on the front half portion of the communication passage S4 has been described, but a configuration without the partition wall 300 as shown in FIGS. 9 and 10 may be employed. In addition, the size, position, number, and the like of the communication passage S4 can be appropriately changed.

While preferred embodiments of the present invention have been described and illustrated above, it should be understood that these embodiments are not to be considered as limiting the present invention. Additions, omissions, substitutions, and other modifications can be made without departing from the scope of the present invention. The present invention is not to be considered as being limited by the foregoing description, and is only limited by the scope of the appended claims.

In the above embodiments, the configuration in which, when the piston 72 reaches the most retracted position, the inside of the piston body 91 and the inside of the cylinder 71 come in communication with each other via the depression 84 has been described, but the present invention is not limited thereto. The position of the piston 72 is not limited as long as at least a portion of the inside of the piston body 91 communicates with the inside of the cylinder 71. For example, a groove or the like may be formed in the piston guide 78 or the inner sliding portion 92 to bring the inside of the piston body 91 in communication with the inside of the cylinder 71 via the groove or the like.

In the above embodiments, the configuration in which the communication passage S4 is formed in the upright and inverted posture adaptor 12 has been described, but the present invention is not limited thereto. The communication passage S4 may be formed in at least one of the upright and inverted posture adaptor 12 and the vertical supply pipe 14, between the outer circumferential surface of the upright and inverted posture adaptor 12 and the inner circumferential surface of the vertical supply pipe 14 (the lower inner tube part 32).

In the above embodiments, the configuration in which the ball valve 41 is used as the second switching valve has been described, but the present invention is not limited thereto, and any configuration can be employed as the second switching valve as long as it can come in contact with and separate from the valve seat.

In the above embodiments, the configuration in which the ball valve 41 is configured to come in contact with the ceiling wall 23*a* of the outer tube 21 formed in a topped tubular shape has been described, but the inner tube 22 may be formed in a topped tubular shape.

Besides, it is possible to appropriately replace the constituent elements in the above embodiments with well-known constituent elements, and the above-described modified examples may be combined as appropriate without departing from the scope of the present invention.

INDUSTRIAL APPLICABILITY

The present invention can be applied to a trigger type liquid ejector.

REFERENCE SIGNS LIST

2 Container body
2*a* Mouth portion
3 Trigger type liquid ejector
10 Ejector body
11 Nozzle
12 Upright and inverted posture adaptor
14 Vertical supply pipe
15 Ejection barrel
15*a* Front end opening portion
21 Outer tube
22 Inner tube
23*a* Ceiling wall
32 Lower inner tube part (mounting tube)
35 Valve seat
40 Accommodation space
41 Ball valve (second switching valve)
63 Trigger
71 Cylinder
72 Piston
78 Piston guide
91 Piston body
92 Inner sliding portion (sliding portion)
93 Outer sliding portion (sliding portion)
102 Accumulator valve
112*a* Ejection hole
140 First fitting member (adaptor body)
141 Second fitting member (adaptor body)
142 Partition member (adaptor body)
153 Inverted posture introduction port
164 Ball valve (first switching valve)
165 Valve chamber (second space)
171*a* Upper end opening (upright posture introduction port)
S1 Connection passage
S2 Recovery passage
S4 Communication passage

The invention claimed is:

1. A trigger type liquid ejector comprising:

an ejector body which is mounted on a container body in which a liquid is accommodated; and a nozzle which is disposed in front of the ejector body, and in which an ejection hole configured to eject the liquid is formed, wherein the ejector body includes:

a vertical supply pipe which extends in an upward/downward direction, and is configured to suction the liquid in the container body;

an ejection barrel which is disposed in front of the vertical supply pipe, and is configured to guide the liquid in the vertical supply pipe to the ejection hole;

a trigger which is disposed in front of the vertical supply pipe to be movable rearward in a state where the trigger is biased forward;

a piston which has a tubular piston body to which the trigger is linked and a sliding portion connected to the piston body, and is configured to move forward and rearward according to forward and rearward movement of the trigger; and a cylinder which has a piston guide inserted into the piston body, and inside of which is pressurized and depressurized by the sliding portion sliding on the cylinder according to forward and rearward movement of the piston, wherein a recovery passage is formed in the ejector body, the recovery passage being configured to bring an inside of the cylinder in communication with an inside of the vertical supply pipe via a space between the piston body and the piston guide, wherein the vertical supply pipe has a mounting tube into which the recovery passage opens, wherein the trigger type liquid ejector further comprises an upright and inverted posture adaptor which is attached into the mounting tube in a state where communication between the recovery passage and an inside of the container body is blocked, wherein the upright and inverted posture adaptor includes:

an adaptor body which defines a first space and a second space, the first space being configured to bring the inside of the container body in communication with the inside of the vertical supply pipe via an upright posture introduction port, the second space being configured to bring the inside of the container body in communication with the first space via an inverted posture introduction port; and a first switching valve which is configured to block communication between the first space and the second space when the container body, on which the ejector body is mounted, is upright, and is configured to allow communication between the first space and the second space when the container body, on which the ejector body is mounted, is inverted, wherein a communication passage is formed between an outer circumferential surface of the upright and inverted posture adaptor and an inner circumferential surface of the mounting tube, the communication passage being configured to bring the recovery passage in communication with the inside of the container body, and wherein a minimum value of a flow passage cross-sectional area of the communication passage is larger than a minimum value of a flow passage cross-sectional area of the recovery passage.

2. The trigger type liquid ejector according to claim 1, wherein the nozzle includes an accumulator valve which is disposed to be movable rearward in a state where the accumulator valve is biased forward, and is configured to openably close a front end opening portion of the ejection barrel.

3. The trigger type liquid ejector according to claim 2, wherein the inverted posture introduction port is disposed on a first side with respect to a center of the upright and inverted posture adaptor in the forward/rearward direction, and the communication passage is disposed on a second side with respect to the center of the upright and inverted posture adaptor in the forward/rearward direction.

4. The trigger type liquid ejector according to claim 1, wherein the inverted posture introduction port is disposed on a first side with respect to a center of the upright and inverted posture adaptor in the forward/rearward direction, and the communication passage is disposed on a second side with respect to the center of the upright and inverted posture adaptor in the forward/rearward direction.

5. The trigger type liquid ejector according to claim 1, wherein the upright and inverted posture adaptor is attached to a lower end portion of the ejector body, wherein the vertical supply pipe is formed in a topped tubular shape, wherein the vertical supply pipe includes:

an inner tube which communicates with the container body, and has the mounting tube and a valve seat protruding from an inner circumferential surface of the inner tube; and an outer tube which surrounds the inner tube, wherein a connection passage is formed between the outer tube and an outer circumferential surface of the inner tube, the connection passage being configured to communicate with the inside of the ejection barrel and the inside of the cylinder, wherein a second switching valve is accommodated in an accommodation space inside the inner tube, the accommodation space being defined by the valve seat and a ceiling wall of the vertical supply pipe and being configured to communicate with the connection passage, the second switching valve being configured to come in contact with and separate from the valve seat, and wherein where D1 is a minimum valve of a cross-sectional area of a gap between the second switching valve and the valve seat in a state where the second switching valve separates from the valve seat and comes in contact with the ceiling wall due to its own weight when the container body is inverted, in a direction perpendicular to the valve seat when seen from a vertical cross-sectional view along the upward/downward direction, and D2 is a minimum valve of an opening area of the valve seat, D1 and D2 are set that $0.62 \leq D2/D1 \leq 3.62$.

6. The trigger type liquid ejector according to claim 5, wherein D1 is set that $1.7\ mm^2 \leq D1 \leq 10.0\ mm^2$.

7. The trigger type liquid ejector according to claim 5, wherein a specific gravity of the second switching valve is larger than that of water.

8. The trigger type liquid ejector according to claim 6, wherein a specific gravity of the second switching valve is larger than that of water.

* * * * *